US011302501B2

(12) United States Patent
Payne et al.

(10) Patent No.: US 11,302,501 B2
(45) Date of Patent: Apr. 12, 2022

(54) CONTACTOR ASSEMBLY AND METHOD OF OPERATING

(71) Applicant: GE Aviation Systems Limited, Gloucestershire (GB)

(72) Inventors: Peter Roy Payne, Cheltenham (GB); John Houghton, Cheltenham (GB); Robert Henry Keith Miles Bullock, Cheltenham (GB)

(73) Assignee: GE Aviation Systems Limited, Gloucestershire (GB)

( * ) Notice: Subject to any disclaimer, the term of this patent is extended or adjusted under 35 U.S.C. 154(b) by 358 days.

(21) Appl. No.: 16/436,318

(22) Filed: Jun. 10, 2019

(65) Prior Publication Data

US 2019/0385805 A1 Dec. 19, 2019

(30) Foreign Application Priority Data

Jun. 18, 2018 (GB) ..... 1809929

(51) Int. Cl.

| | |
|---|---|
| ***H01H 50/60*** | (2006.01) |
| ***H01H 50/24*** | (2006.01) |
| ***H01H 50/36*** | (2006.01) |
| ***H01H 50/04*** | (2006.01) |
| *H01H 1/06* | (2006.01) |

(52) U.S. Cl.

CPC ..... *H01H 50/60* (2013.01); *H01H 50/045* (2013.01); *H01H 50/24* (2013.01); *H01H 50/36* (2013.01); *H01H 1/06* (2013.01)

(58) Field of Classification Search

CPC ..... H01H 50/60; H01H 50/24; H01H 1/06; H01H 1/2041; H01H 50/045; H01H 50/36; H01H 50/54; H01H 51/06; H01H 51/14

See application file for complete search history.

(56) References Cited

U.S. PATENT DOCUMENTS

| | | | |
|---|---|---|---|
| 2,417,788 | A | 3/1947 | Soffel |
| 2,767,357 | A | 10/1956 | Naybor |
| 2,833,883 | A | 5/1958 | Auten |
| 2,863,103 | A | 12/1958 | Tancred |

(Continued)

FOREIGN PATENT DOCUMENTS

| | | | |
|---|---|---|---|
| CN | 108028144 | A | 5/2018 |
| JP | 2017224439 | A | 12/2017 |

(Continued)

OTHER PUBLICATIONS

Chinese Patent Office, Office Action re Corresponding Application No. 201910527459.X, dated Jan. 19, 2021, 9 pages, China.

(Continued)

*Primary Examiner* — Bernard Rojas
(74) *Attorney, Agent, or Firm* — McGarry Bair PC

(57) ABSTRACT

A contactor assembly and method for operating the contactor assembly can include a first conductor having a first set of axially extending protrusions and a second conductor having a second set of axially extending protrusions interdigitally arranged with the first set of protrusion. At least a subset of the first set of extending protrusions and at least a subset of the second set of protrusions can be conductively connected.

17 Claims, 5 Drawing Sheets

(56) References Cited

U.S. PATENT DOCUMENTS

| | | | | |
|---|---|---|---|---|
| 3,254,174 | A * | 5/1966 | Elliott | H01H 67/06 335/206 |
| 3,631,366 | A * | 12/1971 | Ugon | H01H 51/22 335/82 |
| 4,689,714 | A | 8/1987 | Eschermann et al. | |
| 5,392,021 | A | 2/1995 | Liao | |
| 10,037,858 | B2 * | 7/2018 | Valivainio | H01H 11/04 |
| 10,424,447 | B2 | 9/2019 | Schneider et al. | |
| 2014/0091062 | A1 * | 4/2014 | Uitto | H01H 33/12 218/154 |
| 2017/0352511 | A1 | 12/2017 | Kitagawa | |
| 2018/0247783 | A1 * | 8/2018 | Cho | H01H 71/128 |

FOREIGN PATENT DOCUMENTS

| | | | |
|---|---|---|---|
| WO | 2009035638 | A1 | 3/2009 |
| WO | 2012168553 | A1 | 12/2012 |

OTHER PUBLICATIONS

European Patent Office, European Search Report re Application No. 19180335.2-1204, dated Nov. 15, 2019, 9 pages, Munich, Germany.

* cited by examiner

CONTACTOR ASSEMBLY AND METHOD OF OPERATING

CROSS REFERENCE TO RELATED APPLICATION(S)

This application claims priority to and benefit of U.K Patent Application No. 1809929.1 filed Jun. 18, 2018, which is incorporated herein in its entirety.

TECHNICAL FIELD

The disclosure relates to a method and apparatus for operating a contactor and more specifically to initiating at least one of disconnecting or connecting of a power supply by the contactor.

BACKGROUND

Power systems, especially power systems in aircraft, manage the supplying of power from power sources, such as generators, to electrical loads. In some instances, contactors or relays can enable or disable the supply of electrical power from a power source, such as a generator, a power bus, or an otherwise upstream component, to another downstream component.

BRIEF DESCRIPTION

In one aspect, the disclosure relates to a contactor assembly, including a first conductor rotatable about a longitudinal axis and having a first set of axially extending protrusions, and a second conductor aligned with the longitudinal axis and rotationally fixed and having a second set of axially extending protrusions interdigitally arranged with the first set of protrusions. At least a subset of the first set of extending protrusions and at least a subset of the second set of protrusions are conductively connected when the first conductor is rotated about the longitudinal axis to a first rotational position, and wherein the first set of extending protrusions and the second set of protrusions are not conductively connected when the first conductor is rotated about the longitudinal axis to a second rotational position.

In another aspect, the disclosure relates to a method of operating a contactor assembly includes selectively applying a rotational force, by a controller module, relative to a first conductor rotatable about a longitudinal axis and having a first set of axially extending protrusions, such that the rotational force rotates the first conductor to conductively intermesh a conductive face of the first set of extending protrusions with a conductive face of a second set of extending protrusions of a second conductor axially aligned with the first conductor.

DETAILED DESCRIPTION

Figure 1:
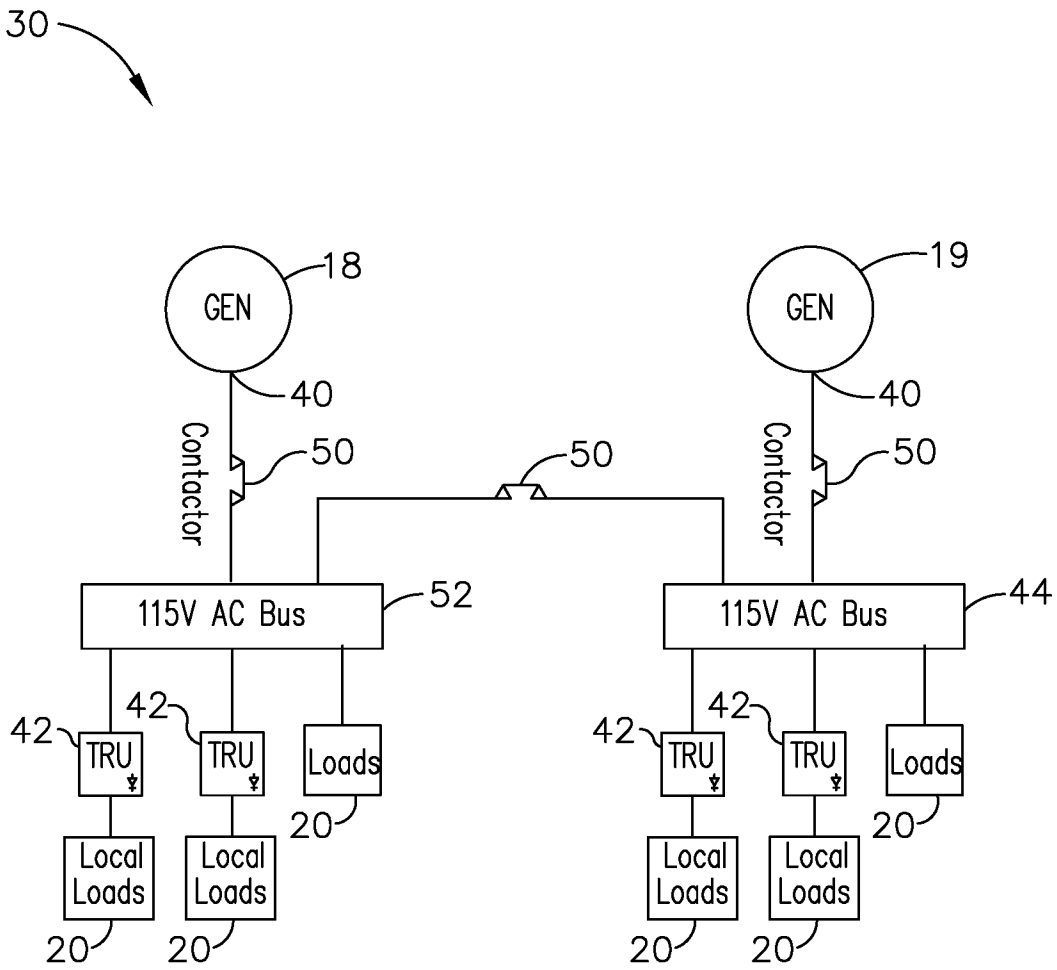
FIG. 1 is a schematic view of a power distribution system in accordance with aspects described herein.

The disclosure is related to a relay or contactor assembly and method of operating, which can be used, for example, in a power distribution system for an aircraft. While this description is primarily directed toward a power distribution system for an aircraft, it is also applicable to any environment utilizing an alternating current or a direct current electrical system, such as any power distribution system in non-aircraft implementations.

As used herein, the terms "upstream" or "downstream" can be used as a reference relative to a current direction for an alternating current circuit, which can reverse direction periodically, defining the meaning of the terms "upstream" or "downstream" based upon the current direction for the circuit. Furthermore, as used herein, the term "set" or a "set" of elements can be any number of elements, including only one. As used herein, the terms "axial" or "axially" refer to a dimension along a longitudinal axis. As used herein, the terms "radial" or "radially" refer to a dimension extending between a center longitudinal axis, an outer circumference, or a circular or annular component disposed as described. The term "angularly" refers to a dimension extending around or about a perimeter of a component centered by the longitudinal axis, such as a dimension extending along the circumference of a circular component. The use of the terms "proximal" or "proximally," either by themselves or in conjunction with the terms "radial" or "radially," refers to moving in a direction toward the center longitudinal axis, or a component being relatively closer to the center longitudinal axis as compared to another component.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Additionally, while terms such as "voltage", "current", and "power" can be used herein, it will be evident to one skilled in the art that these terms can be interrelated when describing aspects of the electrical circuit, or circuit operations.

Also as used herein, while sensors can be described as "sensing" or "measuring" a respective value, sensing or measuring can include determining a value indicative of or related to the respective value, rather than directly sensing or measuring the value itself. The sensed or measured values can further be provided to additional or separate components. Such a provision can be provided as a signal, such as an electrical signal, to said additional or separate components. For instance, the measured value can be provided to a controller module or processor, and the controller module or processor can perform processing on the value to determine a representative value or an electrical characteristic representative of said value.

As used herein, a "system" or a "controller module" can include at least one processor and memory. Non-limiting examples of the memory can include Random Access Memory (RAM), Read-Only Memory (ROM), flash memory, or one or more different types of portable electronic memory, such as discs, DVDs, CD-ROMs, etc., or any suitable combination of these types of memory. The processor can be configured to run any suitable programs or executable instructions designed to carry out various methods, functionality, processing tasks, calculations, or the like, to enable or achieve the technical operations or operations described herein. The program can include a computer program product that can include machine-readable media for carrying or having machine-executable instructions or data structures stored thereon. Such machine-readable media can be any available media, which can be accessed by a general purpose or special purpose computer or other machine with a processor. Generally, such a computer program can include routines, programs, objects, components, data structures, etc., that have the technical effect of performing particular tasks or implement particular abstract data types.

Referring now to FIG. 1, a schematic illustration is shown of an exemplary power distribution system 30 that can be utilized in an aircraft or another power distributing environment. It will be understood that while the power distribution system 30 is described in an aircraft environment, the power distribution system 30 is not so limited and has general application to electrical power systems in non-aircraft applications, such as other mobile applications and non-mobile industrial, commercial, and residential applications. The power distribution system 30 is shown having a set of power sources, such as a first generator 18 and a second generator 19. While two generators 18, 19 are shown, aspects of the disclosure can include any number of generators or power sources, as desired. In addition, the set of generators 18, 19 can include a respective power output 40 for supplying power to various system components. While the set of generators 18, 19 is illustrated similarly, it is contemplated that the set of generators 18, 19 can supply or generate substantially similar electrical power output characteristics or varying electrical power output characteristics.

Each generator 18, 19 can be selectively connected via its power output 40 to a respective power bus of the power distribution system 30, shown as a first power bus 52 connectable with the first generator 18 and a second power bus 44 connectable with the second generator. A contactor, or contactor assembly 50, can be utilized between each generator 18, 19 and its respective power bus 44, 52 as a relay or switch to selectively connect the generator 18, 19 to the power bus 44, 52. As used herein, a contactor assembly 50 can include a selectively controllable device adapted or configured to enable switching, connecting, or disconnecting between respective components. The set of power buses 44, 52 can further be connected with a corresponding set of electrical loads 20. In one non-limiting example, a subset of electrical loads 20 can be connected with a respective power bus 44, 52 by way of at least one transformer rectifier unit (TRU) 42. As used herein, a TRU 42 can be configured or adapted to convert or rectify the electrical power characteristics of the supplied power from the power bus 44, 52 to another, a different, an alternative, or an appropriate electrical power characteristic for a given electrical load 20. Additionally, while not shown, the multiple power buses 44, 52 can be selectively connected or coupled together by way of an additional contactor assembly 50, for instance, to tie one power bus 52 with at least another power bus 44. In this instance, a power source or supply, such as the first generator 18, can selectively or operably supply power to the first power bus 52, which can be further shared, supplied, or supplemented with the second power bus 44, by way of a contactor assembly 50.

It will be understood that while aspects of the disclosure are shown in an aircraft environment of FIG. 1, the disclosure is not so limited and can have applicability in a variety of environments. For example, while this description is directed toward a power system architecture in an aircraft, aspects of the disclosure can be further applicable to provide power, supplemental power, emergency power, essential power, or the like, in otherwise non-emergency operations, such as takeoff, landing, or cruise flight operations, or ground operations.

Furthermore, the number of, and placement of, the various components depicted in FIG. 1 are also non-limiting examples of aspects associated with the disclosure. For example, while various components have been illustrated with relative position of the power distribution system 30, aspects of the disclosure are not so limited, and the components are not so limited based on their schematic depictions. Additional power distribution configurations are envisioned.

Figure 2:
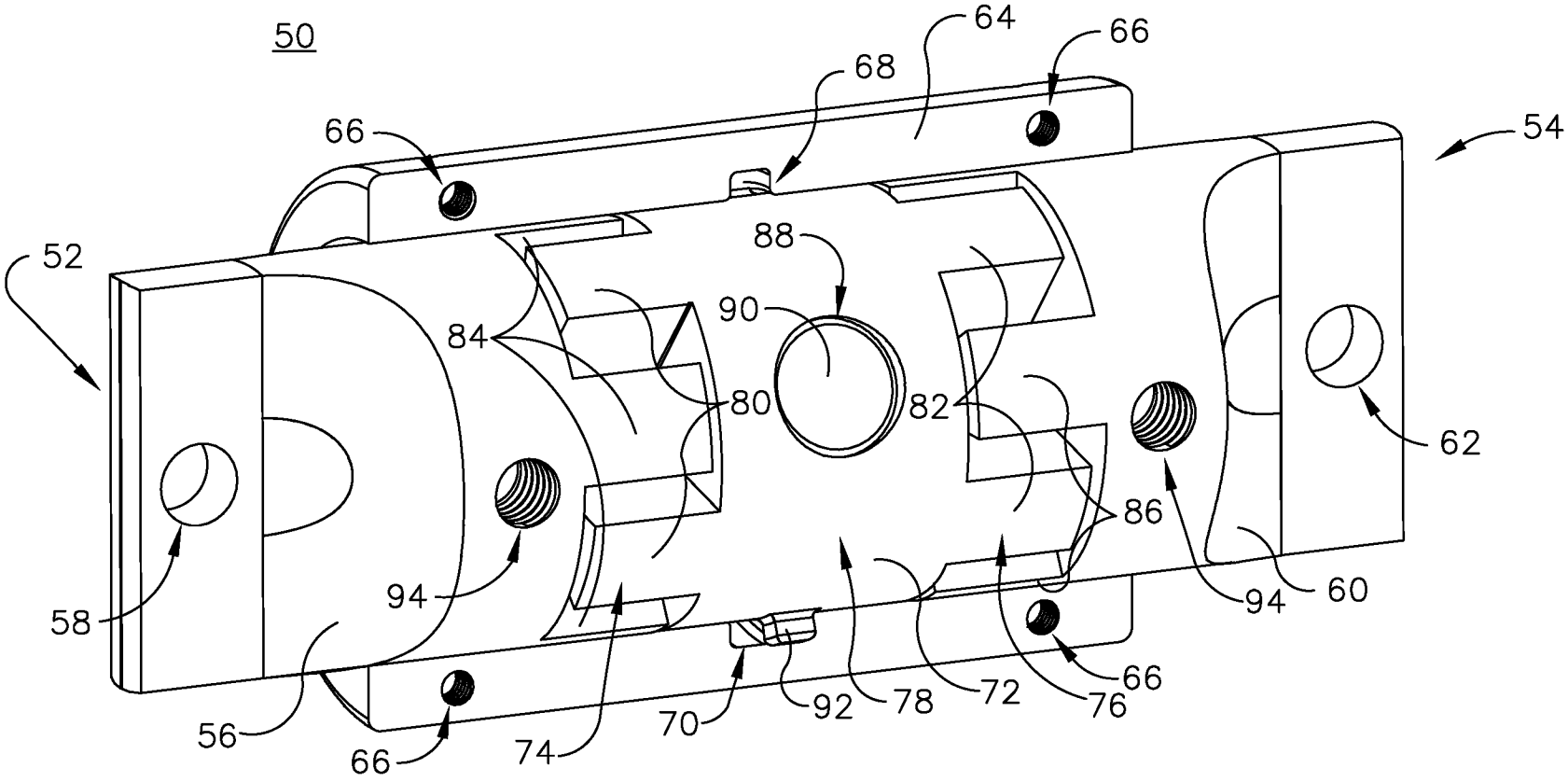
FIG. 2 is an isometric view of a contactor assembly, in accordance with aspects described herein.

FIG. 2 illustrates an isometric view of the contactor assembly 50 of FIG. 1, in accordance with aspects described herein. In the view of FIG. 2, a portion of the housing has been removed for understanding.

As illustrated, the contactor assembly 50 includes a first end 52 and a distal second end 54. The contactor assembly 50 can further include a first conductor 72 positioned between the first end 52 and second end 54, and is shown having a first axial contactor end 74 and a distal second axial contactor end 76. The contactor assembly 50 can further include a second conductor 56 axially arranged relative to first axial contactor end 74 of the first conductor 72 and proximate to the first end 52 of the contactor assembly 50, and a third conductor 60 axially arranged relative to second axial contactor end 76 of the first conductor 72 and proximate to the second end 54 of the contactor assembly 50. The second and third conductors 56, 60 are spaced from each other by the first conductor 72. The first, second, and third conductors 72, 56, 60 can each comprise a substantially electrically conductive material, including but not limited to, copper, aluminum, the like, or an alloy of electrically conductive materials. The first, second, and third conductors 72, 56, 60 are shown having a substantially circular or cylindrical form coaxially aligned between the first and second ends 52, 54. However, additional geometric configurations can be included for one or more of the conductors 56, 60, 72.

The first axial contactor end 74 can include a first set of axially extending protrusions 80, such as axially extending fingers, gear teeth, or the like angularly arranged and spaced from one another about a perimeter of the first conductor 72. In one non-limiting example, the perimeter of the first conductor 72 can include an axially extending outer surface 78 or circumference of the first conductor 72. The proximate portion of the second conductor 56 can include a corresponding second set of axially extending protrusions 84 angularly arranged and spaced from one another. The second set of extending protrusions 84 can be substantially similar to the first set of extending protrusions 80, and can be adapted, configured, or the like to be interdigitally arranged with the first set of extending protrusions 80 when assembled. In one non-limiting example, the configuration or adaptation of the first and second sets of extending protrusions 80, 84 can allow for a relative rotation between the extending protrusions 80, 84, or a relative rotation of the first conductor 72 relative the second conductor 56. As used herein, "interdigitally arranged" means an angular position alternating between first and second sets of extending protrusions 80, 84.

The third conductor 60 can also include a third set of axially extending protrusions 86, similar to the second set of extending protrusions 84 but extending in the opposite axial direction toward the second axial contactor end 76. The second axial contactor end 76 can further include a fourth set of axially extending protrusions 82, similar to the first set of extending protrusions 80, but extending axially toward and interdigitally arranged with the third set of extending protrusions 86. In one non-limiting example, the configuration or adaptation of the third and fourth sets of extending protrusions 82, 86 can allow for a relative rotation between the extending protrusions 82, 86, or a relative rotation of the first conductor 72 relative the third conductor 60.

Non-limiting aspects of the disclosure can be included wherein the sets of extending protrusions 80, 82, 84, 86 can be arranged with equal or similar angular dimensions (e.g. a perimeter length or axial-facing surface area), and can include equal angular spacing between respective protrusions 80, 82, 84, 86.

The contactor assembly 50 can also include a non-conductive housing, shown as a first housing portion 64, enveloping, encircling, encasing, or the like, at least a portion of the first, second, and third conductors 72, 56, 60. A corresponding second housing portion has been removed from the view of FIG. 2, and can be substantially similar to the first housing portion 64. The first conductor 72 can include a magnet seat 88 configured or adapted to receive a magnet 90 at the outer surface 78. In one example, the magnet seat 88 or magnet 90 can be selected or adapted such that the receiving of the magnet 90 in the magnet seat 88 does not alter the contours of the outer surface 78, or alter operation of the contactor assembly 50, as described herein. In another non-limiting example configuration, the first conductor 72 can include one or more bosses 92 extending from the outer surface 78 of the first conductor 72. The bosses 92 can axially align with or correspond to an upper channel 68 and a lower channel 70 formed in the first housing portion 64.

The bosses 92 can be keyed to the channels 68, 70 such that the channels 68, 70 can act as a guide for the bosses 92 within the assembled housing portions 64. Additional non-limiting aspects of the disclosure can be included wherein at least one of the housing portions 64 can include any suitable mounting components or mounting connectors including, but not limited to, mechanical fasteners, screws, epoxy, adhesive, or force or tension mountings. As shown, the first housing portion 64 includes a set of mechanical fastener interfaces, shown as a set of threaded aperture 66 for receiving a screw, adapted for assembling the respective housing portions 64 together, or to the contactor assembly 50.

Non-limiting aspects of the disclosure can be included wherein the first conductor 72 is axially rotatable relative to second conductor 56, the third conductor 60, and the housing portions 64. In this instance, each of the second and third conductors 56, 60 can be rotationally "fixed" relative to the contactor assembly 50 or housing portions 64, while the first conductor 72 or rotatable within the contactor assembly 50 or housing portions 64. In one non-limiting example, each of the second and third conductors 56, 60 can be rotationally fixed relative the housing portions 64 by way of any suitable mounting materials or mounting techniques include, but not limited to, mechanical fasteners, screws, epoxy, adhesive, or force or tension mountings. As shown, the second and third conductors 56, 60 can include mechanical fastener interfaces, such as a threaded aperture 94 for receiving a screw. In this sense, when the contactor assembly 50 is assembled, the channels 68, 70 of the housing portions 64 can act as a guide for the bosses 92 when the first conductor 72 is rotated relative to the contactor assembly 50.

Additionally, the second conductor 56 is shown having a first end conductive contact point 58 (shown as an aperture) that can be conductively connected with an upstream electrical component (such as a generator 18, 19, as shown in FIG. 1). Similarly the third conductor 60 is shown having a second end conductive contact point 62 that can be conductively connected with a downstream electrical component (such as a power bus 44, 52, as shown in FIG. 1). In this sense, the contactor assembly 50 can be electrically positioned between electrical components, and can be operable to electrically connect or disconnect respective electrical components, as described herein. While first and second end conductive contact points 58, 62 are shown, and electrical connection to upstream or downstream electrical components can be included.

Figure 3:
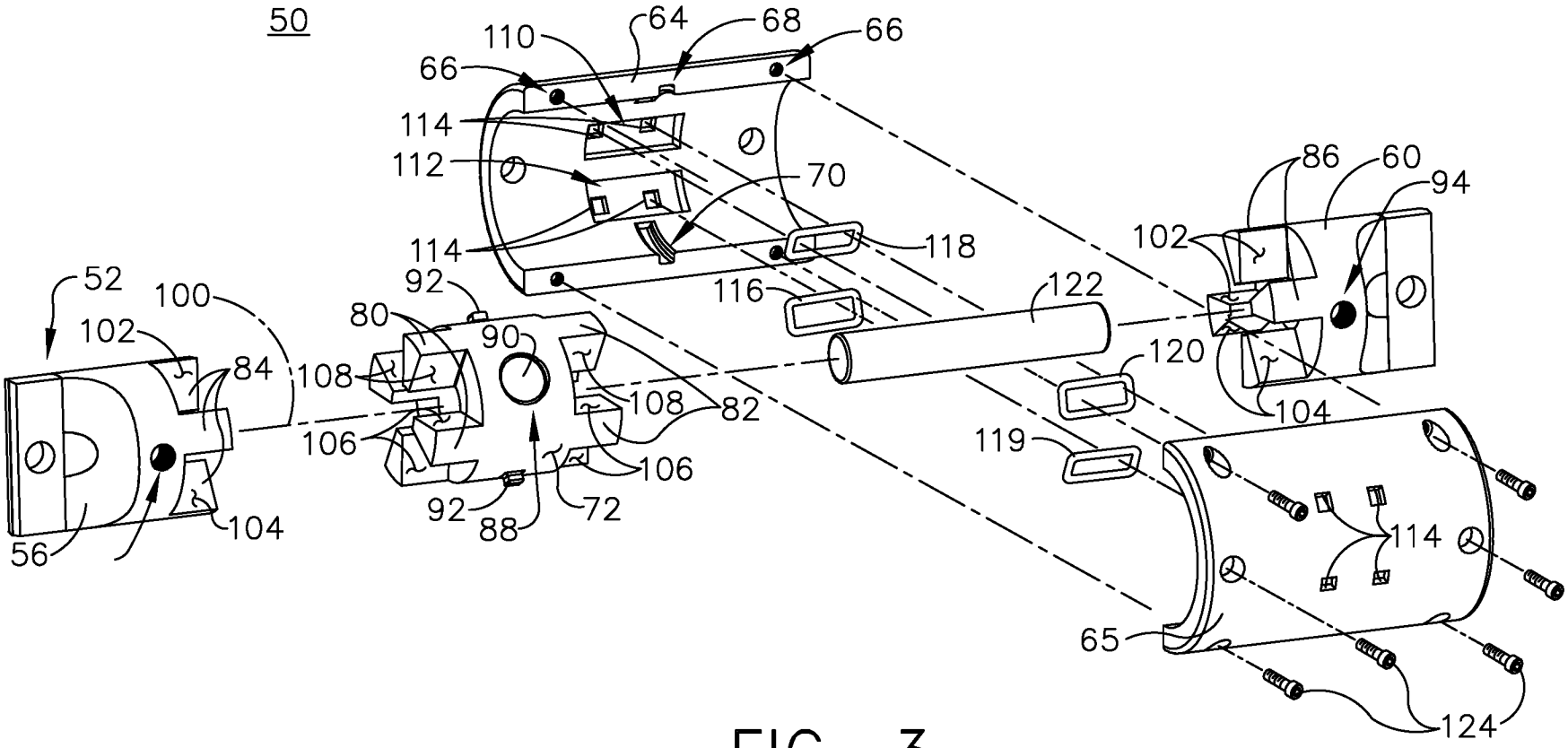
FIG. 3 is an exploded isometric view of the contactor assembly of FIG. 2, in accordance with aspects described herein.

FIG. 3 illustrates an exploded isometric view of the contactor assembly 50 along a longitudinal axis 100, illustrating further aspects of the disclosure. As shown, the first conductor 72 can receive a non-conductive cylindrical shaft 122 about which the first conductor 72 can rotate. Each of the second and third conductors 56, 60 can receive at least a portion of opposing axial ends of the cylindrical shaft 122 when the contactor assembly 50 is assembled. In one non-limiting example, the cylindrical shaft 122 can be axially sized such that the second and third conductors 56, 60 are spaced at, held at, or separated by a predetermined length to ensure the first conductor 72 is not axially in contact with either of the second or third conductors 56, 60 when assembled. In another non-limiting aspect, the receiving of the bosses 92 of the first conductor 72 in the channels 68, 70 of the first housing portion 64 and a second housing portion 65 can further axially position the first conductor 72 such that it is not axially in contact with either of the second or third conductors 56, 60 when assembled. In yet another non-limiting example, the axial faces of at least some of the first conductor 72 (e.g. the axial faces of the first or fourth set of extending protrusions 80, 82), the second conductor 56 (e.g. the axial faces of the second set of extending protrusions 84), or the third conductor 60 (e.g. the axial faces of the third set of extending protrusions 86) can include a non-conductive layer to prevent axial electrical contact between the respective components.

As shown, the first set of extending protrusions 80 of the first conductor 72 can further define a first set of radially extending angular faces 106 and a second set of radially extending angular faces 108. A first angular face 106 of one protrusion 80 of the first set of extending protrusions 80 is adjacent to a second angular face 108 of another or an adjacent protrusion 80 of the first set of extending protrusions 80. In this sense, each protrusion 80 of the first set of extending protrusions 80 includes a first angular face 106 and a second opposing angular face 108. In one non-limiting example, when viewing the first conductor 72 from an axial view from the second conductor 56, each opening between protrusions 80 will include a first face 106 in the clockwise direction and a second face 108 in a counterclockwise direction. In one example, the first set of angular faces 106 can be non-conductive faces, or can include an electrically non-conductive layer. In another example, the second set of angular faces 108 can be conductive faces.

Also as shown, the second set of extending protrusions 84 of the second conductor 56 can further define a third set of radially extending angular faces 102 and a fourth set of radially extending angular faces 104. A third angular face 102 of one protrusion 84 of the second set of extending protrusions 84 is adjacent to a fourth angular face 104 of another or an adjacent protrusion 84 of the second set of extending protrusions 84. In this sense, each protrusion 84 of the second set of extending protrusions 84 includes a third angular face 102 and a fourth opposing angular face 104. In one non-limiting example, when viewing the second conductor 56 from an axial view from the first conductor 72, each opening between protrusions 84 will include a third face 102 in the clockwise direction and a fourth face 104 in a counterclockwise direction. In one example, the third set of angular faces 102 can be non-conductive faces, or can include an electrically non-conductive layer. In another example, the fourth set of angular faces 104 can be conductive faces.

When the contactor assembly 50 is assembled along the longitudinal axis 100 and the cylindrical shaft 122, the interdigital arrangement of the first set of extending protrusions 80 and the second set of extending protrusions 84 will bring the first set of angular faces 106 in a proximate, adjacent, or facing relationship with the third set of angular faces 102, and will bring the second set of angular faces 108 in a proximate, adjacent, or facing relationship with the fourth set of angular faces 104. As previously described, the first and third sets of angular faces 106, 102 can include non-conductive faces, while the second and fourth sets of angular faces 108, 104 can include conductive faces.

During operation, a first direction of rotation of the first conductor 72 (e.g. a clockwise rotation when viewing the first conductor 72 along the axis 100 from the direction of the second conductor 56) about the cylindrical shaft 122 or the longitudinal axis 100 can bring the second set of angular faces 108 into conductive contact with the fourth set of angular faces 104 of the rotationally fixed second conductor 56. Also during operation, a second, opposite direction of rotation of the first conductor 72 (e.g. counterclockwise rotation) about the cylindrical shaft 122 or the longitudinal axis 100 can disconnect the second set of angular faces 108 from conductive contact with the fourth set of angular faces 104 of the rotationally fixed second conductor 56. In another non-limiting example, the second direction of rotation of the first conductor 72 about the cylindrical shaft 122 or the longitudinal axis 100 can further bring the first set of angular faces 106 into non-conductive contact with the third set of angular faces 102 of the rotationally fixed second conductor 56.

Similarly shown, the fourth set of extending protrusions 82 of the first conductor 72 can further define a first set of radially extending angular faces 106 and a second set of radially extending angular faces 108 that are angularly aligned with the first and second sets of extending angular faces 106, 108 of the first set of extending protrusions 80. The first and a second sets of extending angular faces 106, 108 of the fourth set of extending protrusions 82 are similar to the first and second sets of extending angular faces 106, 108 of the first set of extending protrusions 80, unless otherwise noted.

Also as shown, the third set of extending protrusions 86 of the third conductor 60 can further define a third set of radially extending angular faces 102 and a fourth set of radially extending angular faces 104 that are angularly aligned with the third and fourth sets of extending angular faces 102, 104 of the second set of extending protrusions 84. The third and a fourth sets of extending angular faces 102, 104 of the third set of extending protrusions 86 are similar to the third and a fourth sets of extending angular faces 102, 104 of the second set of extending protrusions 84, unless otherwise noted.

Thus, when the contactor assembly 50 is assembled along the longitudinal axis 100 and the cylindrical shaft 122, the interdigital arrangement of the fourth set of extending protrusions 82 and the third set of extending protrusions 86 will bring the first set of angular faces 106 in a proximate, adjacent, or facing relationship with the third set of angular faces 102, and will bring the second set of angular faces 108 in a proximate, adjacent, or facing relationship with the fourth set of angular faces 104. As previously described, the first and third sets of angular faces 106, 102 can include non-conductive faces, while the second and fourth sets of angular faces 108, 104 can include conductive faces.

During operation, the first direction of rotation of the first conductor 72 (e.g. a clockwise rotation when viewing the first conductor 72 along the axis 100 from the direction of the second conductor 56) about the cylindrical shaft 122 or the longitudinal axis 100 can bring the second set of angular faces 108 into conductive contact with the fourth set of angular faces 104 of the rotationally fixed third conductor 60. Aspects of the disclosure can be included wherein conductive contact between the first conductor 72 and the second conductor 56 occurs simultaneously with the conductive contact between the first conductor 72 and the third conductor 60, as described. Also during operation, the second, opposite direction of rotation of the first conductor 72 (e.g. counterclockwise rotation) about the cylindrical shaft 122 or the longitudinal axis 100 can disconnect the second set of angular faces 108 from conductive contact with the fourth set of angular faces 104 of the rotationally fixed third conductor 60. In another non-limiting example, the second direction of rotation of the first conductor 72 about the cylindrical shaft 122 or the longitudinal axis 100 can further bring the first set of angular faces 106 into non-conductive contact with the third set of angular faces 102 of the rotationally fixed third conductor 60.

In this sense, the second conductor 56 and the third conductor 60 are electrically or conductively connected when the first conductor 72 is rotated about the longitudinal axis 100 to a first rotational position (e.g. wherein the respective second and fourth sets of angular faces 108, 104 are in conductive contact), and wherein the second conductor 56 the third conductor 60 are not electrically or conductively connected when the first conductor 72 is rotated about the longitudinal axis 100 to a second rotational position (e.g. wherein the respective second and fourth sets of angular faces 108, 104 are not in conductive contact, or wherein the first and third sets of angular faces 106, 102 are in non-conductive contact).

As shown, the first housing portion 64 can further include at least one magnetic coil seat, and is shown having a first magnetic coil seat 110 and a second magnetic coil seat 112. Each magnetic coil seat 110, 112 is shown having a set of apertures 114 extending radially through the first housing portion 64 and can be sized or shaped to receive a conductor, such as a wire or a set of wires. Each respective magnetic coil seat 110, 112 can be sized or shaped to receive an energizable magnetic coil, shown as a first magnetic coil 118 received by the first magnetic coil seat 110 and a second magnetic coil 116 received by the second magnetic coil seat 112. The magnetic coils 116, 118 are illustrated schematically for ease of understanding. Each of the magnetic coils 116, 118 can be independently energized or energizable to generate a magnetic field relative to the magnetic coil 116, 118. In one non-limiting example, the energization of the magnetic coil 116, 118 can occur by way of selectively energized conductive wire connected with each respective coil 116, 118 via the set of apertures 114. While not fully illustrated in the perspective of FIG. 3, the second housing portion 65 can similarly include at least one magnetic coil seat, associated magnetic coils shown as a third magnetic coil 119 and a fourth magnetic coil 120. Similarly, each of the magnetic coils 119, 120 can be independently energized or energizable to generate a magnetic field relative to the magnetic coil 119, 120 by way of conductors received via the set of apertures 114. Each of the magnetic coils 116, 118, 119, 120 can be axially positioned to correspond with a respective magnet 90 of the first conductor 72, when the contactor assembly 50 is assembled.

Additionally, a set of mechanical fasteners 124 are shown as an example for assembling of the contactor assembly 50.

Figure 4:
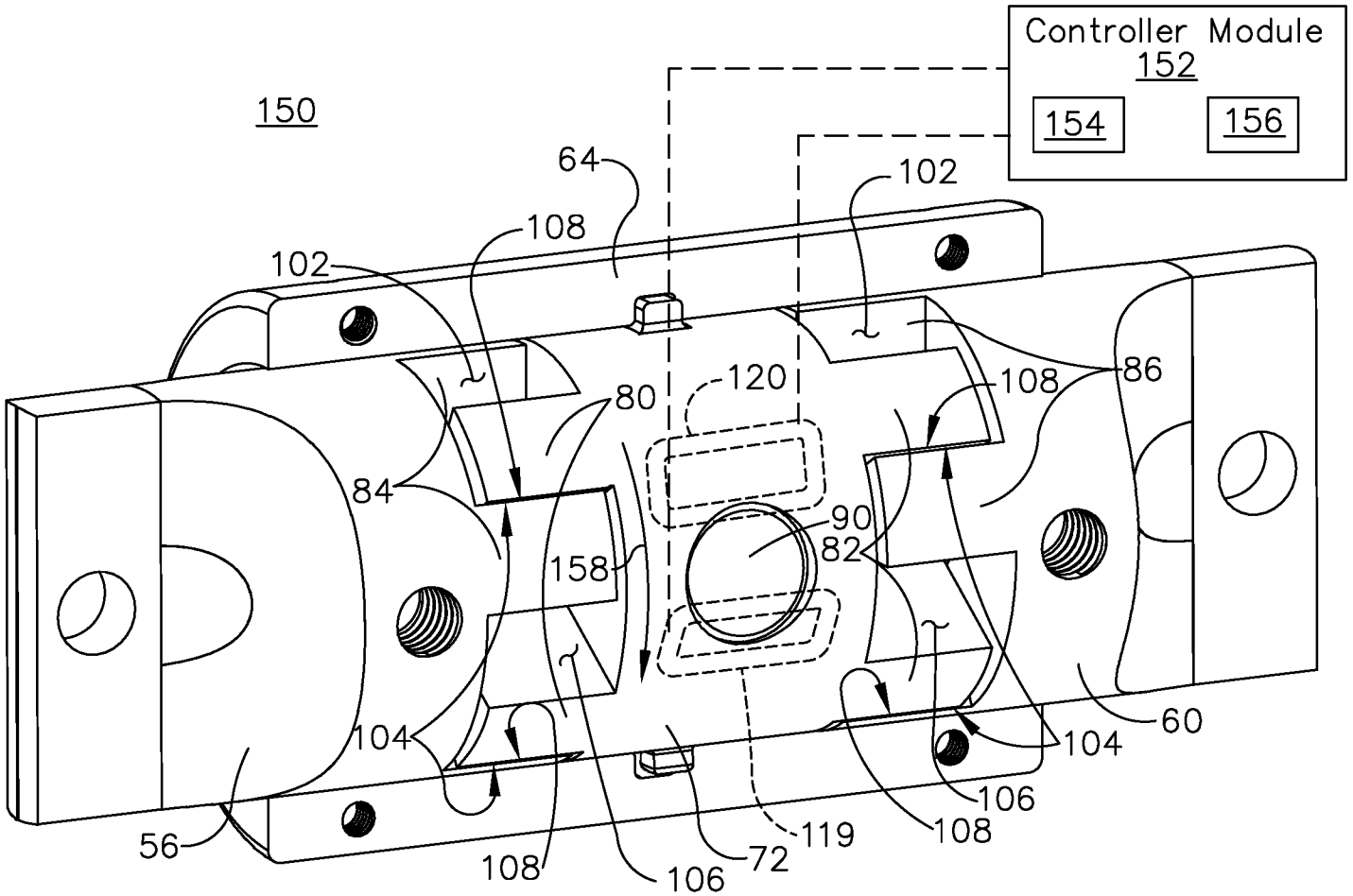
FIG. 4 is an isometric view of the contactor assembly of FIG. 2 in a first rotational position, in accordance with aspects described herein.

Turning now to FIG. 4, a first example is shown of the contactor assembly 150 wherein the second and third conductors 56, 60 are electrically or conductively connected. The contactor assembly 150 is similar to the contactor assembly 50 except with regards to the rotational position of the first conductor 72. The third magnetic coil 119 and the fourth magnetic coil 120 are illustrated in dotted outline to represent where they would be respectively positioned when the second housing portion 65 (not shown) is assembled with the contactor assembly 50, 150. As shown, an example controller module 152 having a processor 154 and memory 156 can be configured to operably and independently energize the third magnetic coil 119. The controller module 152 can be configured to energize the third magnetic coil 119, for example, in response to receiving or generating a control signal to electrically connect the second and third conductors 56, 60 (e.g. a control signal to "close" the contactor or contactor assembly 50, 150). The energization of the third magnetic coil 119 can in turn create or generate a magnetic field that attracts the magnet 90 of the first conductor 72, and thus generates a rotational force to rotate the first conductor in a clockwise rotation 158 and bringing the second sets of angular faces 108 into conductive contact with the fourth sets of angular faces 104 of the second and third conductors 56, 60. The illustrated example can represent the first rotational position wherein, for example, electrical energy can be carried from the second conductor 56 to the third conductor 60 (or vice versa) by way of the conductive angular connection between respective conductive faces 104, 108.

While not shown due to the perspective of FIG. 4, the opposing side of the contactor assembly 50, 150 can similarly include a magnet seat 88 and a magnet 90 positioned axially relative to the respective first magnetic coil 118 and second magnetic coil 116. In this sense, non-limiting aspects of the disclosure can be included wherein the controller module 152 can be configured to simultaneously energize the first magnetic coil 118 and the third magnetic coil 119 to create or generate a set attractive magnetic fields relative to the respective magnets 90, and thus generates a rotational force to rotate the first conductor in a clockwise rotation 158 and bringing the sets of angular faces 104, 108 into conductive contact.

In yet another non-limiting example, the controller module 152 can be configured to energize the fourth magnetic coil 120, the second magnetic coil 116, or a combination thereof, to create or generate a set repulsive magnetic fields relative to the respective magnets 90, and thus pushes the magnets 90 away from the one or more magnetic coils 116, 120, generating the rotational force to rotate the first conductor in a clockwise rotation 158 and bringing the sets of angular faces 104, 108 into conductive contact. In yet another non-limiting example, the controller module 152 can be configured to selectively or independently energize any permutation or combination of magnetic coils 116, 118, 119, 120 to generate an attractive or repulsive interaction with respective magnets 90 to generate the rotational force to rotate the first conductor in a clockwise rotation 158 and bringing the sets of angular faces 104, 108 into conductive contact.

Figure 5:
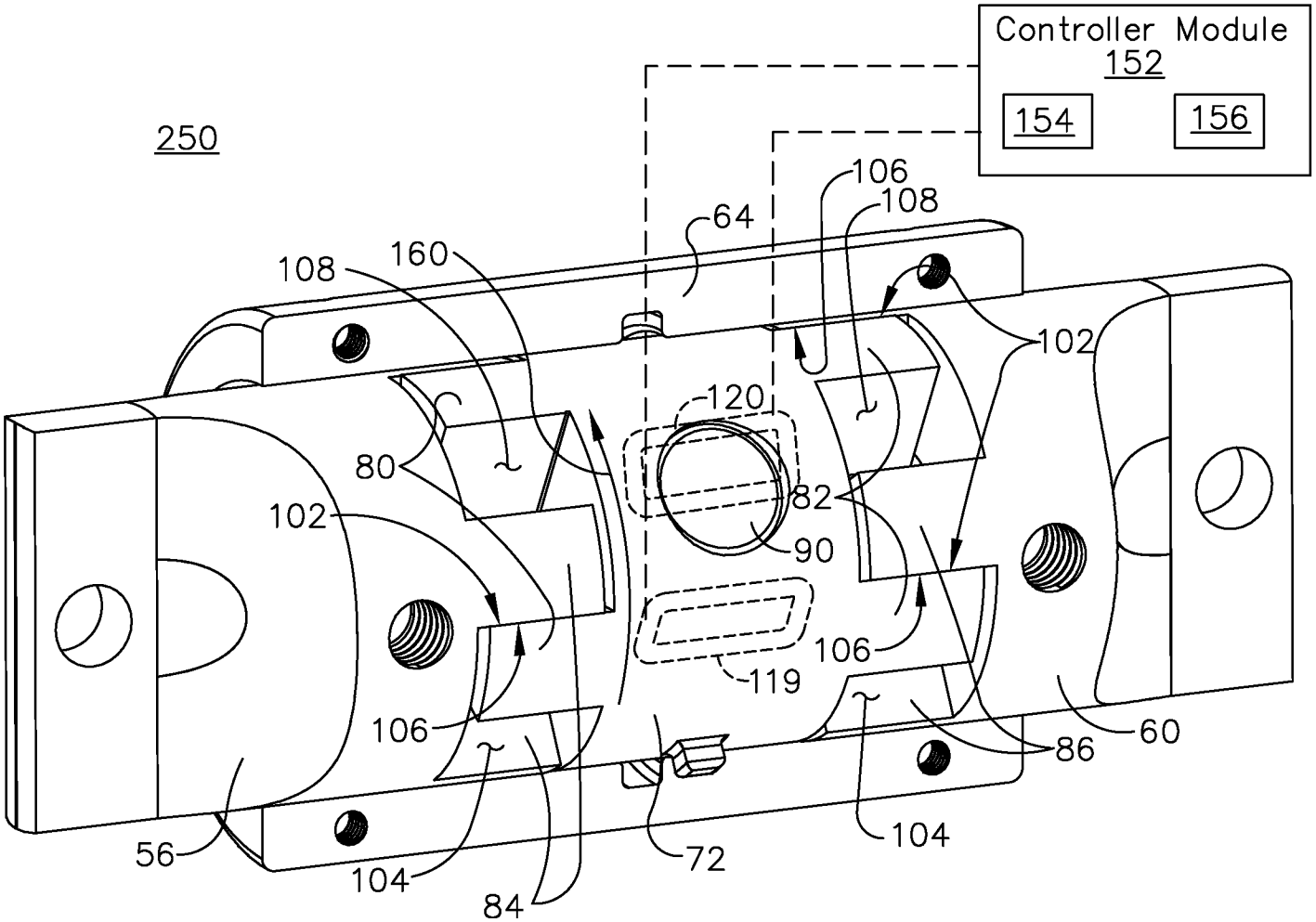
FIG. 5 is an isometric view of the contactor assembly of FIG. 2 in a second rotational position, in accordance with aspects described herein.

FIG. 5 illustrates a second example showing the contactor assembly 250 wherein the second and third conductors 56, 60 are not electrically or conductively connected. The contactor assembly 250 is similar to the contactor assembly 50, 150 except with regards to the rotational position of the first conductor 72. As shown, the controller module 152 can be configured to operably and independently energize the fourth magnetic coil 120. The controller module 152 can be configured to energize the fourth magnetic coil 120, for example, in response to receiving or generating a control signal to electrically disconnect the second and third conductors 56, 60 (e.g. a control signal to "open" the contactor or contactor assembly 50, 250). The energization of the fourth magnetic coil 120 can in turn create or generate a magnetic field that attracts the magnet 90 of the first conductor 72, and thus generates a rotational force to rotate the first conductor in a counterclockwise rotation 160 and separate the second sets of angular faces 108 from conductive contact with the fourth sets of angular faces 104 of the second and third conductors 56, 60. In one non-limiting example, the rotational force or the counterclockwise rotation 160 can bring the first set of angular faces 106 in non-conductive contact with the third set of angular faces 102, as described herein. The illustrated example can represent the second rotational position wherein, for example, electrical energy cannot be carried from the second conductor 56 to the third conductor 60 (or vice versa) by way of the non-conductive angular connection between respective non-conductive faces 102, 106 or the separation of conductive faces 104, 108.

In another non-limiting aspects of the disclosure, the controller module 152 can be configured to simultaneously energize the second magnetic coil 116 and the fourth magnetic coil 120 to create or generate a set attractive magnetic fields relative to the respective magnets 90, and thus generates a rotational force to rotate the first conductor in a counterclockwise rotation 160 and separating the sets of angular faces 104, 108. In yet another non-limiting example, the controller module 152 can be configured to energize the third magnetic coil 119, the first magnetic coil 118, or a combination thereof, to create or generate a set repulsive magnetic fields relative to the respective magnets 90, and thus pushes the magnets 90 away from the one or more magnetic coils 118, 119, generating the rotational force to rotate the first conductor in a counterclockwise rotation 160 and separating the sets of angular faces 104, 108 from conductive contact. In yet another non-limiting example, the controller module 152 can be configured to selectively or independently energize any permutation or combination of magnetic coils 116, 118, 119, 120 to generate an attractive or repulsive interaction with respective magnets 90 to generate the rotational force to rotate the first conductor in a counterclockwise rotation 160 and separating the sets of angular faces 104, 108 from conductive contact or bringing non-conductive sets of angular faces 102, 106 into non-conductive contact.

Many other possible aspects and configurations in addition to that shown in the above figures are contemplated by the present disclosure. For example, one aspect of the disclosure contemplates only a single phase of alternating or direct current (e.g. AC or DC), but aspects of the disclosure can be included wherein the number of protrusions of the respective conductors 56, 60, 72 can be configured to account for multiple electrically isolated phases of current. In this example, each respective protrusion, or sets of radially opposing protrusions can be connected to a common phase, such that each respective phase of power can be connected by at least two conductive faces of the protrusions. In another non-limiting example, aspects of the disclosure can include only one magnetic coil or energization of the magnetic coil relative to the magnet, and wherein de-energizing the magnetic coil results in the counterclockwise rotation 160 of the first conductor 72 due to a rotational biasing mechanism, such as a spring or the like. In this sense, the natural bias of the contactor assembly is in the disconnected or "open" position, and wherein the energizing of the magnetic coil reliably overcomes the natural bias to rotate the first conductor 72 in the clockwise rotation 158. In yet another non-limiting example of the disclosure, the rotation 158, 160 of the first conductor 72 can occur by way of non-magnetic rotational forces, including but not limited to pneumatic forces, spring or mechanical forces, or the like. Additionally, the design and placement of the various components can be rearranged such that a number of different in-line configurations could be realized.

Aspects of the disclosure describe a contactor assembly 50, 150, 250 utilizing a rotatable conductor 72 to enable or disable electrical connections between respective conductors 56, 60. In this sense, aspects of the disclosure can further include a method of operating the contactor assembly 50, 150, 250. The method can include selectively energizing a first magnetic field, by a controller module 152, relative to a magnet 90 fixed along the outer surface 78 of a first conductor 72 rotatable about a longitudinal axis 100 and having a first set of axially extending protrusions 80, such that the attraction of the first magnetic field and the magnet 90 rotates 158 the first conductor 72 to conductively intermesh a conductive face 108 of the first set of extending protrusions 80 with a conductive face 104 of a second set of extending protrusions 84 of a second conductor 56 axially aligned with the first conductor 72. Non-limiting aspects of the method can further include selectively de-energizing the first magnetic field, by the controller module 152, such that the first conductor 72 rotates 160 to separate the conductive face 108 of the first set of extending protrusions 80 from the conductive face 104 of the second set of extending protrusions 84. In yet another non-limiting example, the method can further include selectively energizing a second magnetic field, by the controller module 152, the second magnetic field opposite of the first magnetic field, such that the repulsion of the second magnetic field and the magnet 90 rotates 160 the first conductor 72 to separate the conductive face 108 of the first set of extending protrusions 80 from the conductive face 104 of the second set of extending protrusions 84. In yet another non-limiting example, the method can further include simultaneously de-energizing the first magnetic field and energizing a second magnetic field, by the controller module 152, the second magnetic field angularly spaced from the first magnetic field, such that the attraction of the second magnetic field and the magnet 90 rotates 160 the first conductor 72 to separate the conductive face 108 of the first set of extending protrusions 80 from the conductive face 104 of the second set of extending protrusions 84.

The technical effect is that the above described aspects enable the disconnecting or connecting of the contactor assembly, as described herein. One advantage that can be realized in the above aspects is that the above described aspects have superior contactor connecting and disconnecting operations while being less susceptible to vibrational effects, for example, due to the operating environment. For instance, on an aircraft, environmental vibration sometimes causes the contacts within a traditional contactor to bounce apart when the holding force maintaining the electrical connection is insufficient. Magnetic attraction or repulsion in a rotational direction, as described herein, can counter or overcome vibrational forces of the contactor assembly, ensuring or maintaining reliable connection or separation of respective conductors.

Another advantage that can be realized in the above aspects is that the contactor assembly can be reduced in size, compared with traditional contactors having similar current ratings. Reduction in size can also reduce manufacturing or material costs. Furthermore, the contactor assembly as described herein can be suitable for different or all types of power supplies, powered electronics or circuit boards, or any suitable electrical power distribution system. It should be appreciated that the contactor assembly provides for effectively disconnecting or connecting a power source from a destination.

Various characteristics, aspects and advantages of the present disclosure may also be embodied in any permutation of aspects of the disclosure, including but not limited to the following technical solutions as defined in the enumerated aspects:

1. A contactor assembly, comprising:
   - a first conductor rotatable about a longitudinal axis and having a first set of axially extending protrusions; and
   - a second conductor aligned with the longitudinal axis and rotationally fixed and having a second set of axially extending protrusions interdigitally arranged with the first set of protrusions;
   - wherein at least a subset of the first set of extending protrusions and at least a subset of the second set of protrusions are conductively connected when the first conductor is rotated about the longitudinal axis to a first rotational position, and wherein the first set of extending protrusions and the second set of protrusions are not conductively connected when the first conductor is rotated about the longitudinal axis to a second rotational position.

2. The contactor assembly of any of the disclosed aspects, further comprising a third conductor aligned with the longitudinal axis, spaced from the second conductor by the first conductor, and rotationally fixed.

3. The contactor assembly of any of the disclosed aspects, wherein the third conductor includes a third set of axially extending protrusions, wherein the first conductor includes a fourth set of axially extending protrusions, and wherein the third set and the fourth set of extending protrusions are interdigitally arranged.

4. The contactor assembly of any of the disclosed aspects, wherein the first set of extending protrusions are angularly aligned about the longitudinal axis with the fourth set of extending protrusions.

5. The contactor assembly of any of the disclosed aspects, wherein the second set of extending protrusions are angularly aligned about the longitudinal axis with the third set of extending protrusions.

6. The contactor assembly of any of the disclosed aspects, wherein the first set of extending protrusions each include a first radially extending angular face and a second radially extending angular face, and wherein the first angular face of one of the first set of extending protrusions is adjacent to the second angular face of another of the first set of extending protrusions.

7. The contactor assembly of any of the disclosed aspects, wherein the second set of extending protrusions each includes a third radially extending angular face and a fourth radially extending angular face, and wherein the third angular face of one of the second set of extending protrusions is adjacent to the fourth angular face of another of the second set of extending protrusions.

8. The contactor assembly of any of the disclosed aspects, wherein, when interdigitally arranged, the first face of the first set of extending protrusions is facing the third face of the second set of extending protrusions, and the second face of the first set of extending protrusions is facing the fourth face of the second set of extending protrusions.

9. The contactor assembly of any of the disclosed aspects, wherein second face of the first set of extending protrusions is in conductive contact with the fourth face of the second set of extending protrusions when the first conductor is rotated about the longitudinal axis to the first rotational position.

10. The contactor assembly of any of the disclosed aspects, wherein at least one of the third face and the first face includes a non-conductive layer.

11. The contactor assembly of any of the disclosed aspects, wherein the first face of the first set of extending protrusions is in non-conductive contact with the third face of the second set of extending protrusions when the first conductor is rotated about the longitudinal axis to the second rotational position.

12. The contactor assembly of any of the disclosed aspects, wherein the first conductor includes a magnet fixed along a first conductor outer surface.

13. The contactor assembly of any of the disclosed aspects, further comprising a controller module configured to selectively energize a magnetic field relative to the magnet.

14. The contactor assembly of any of the disclosed aspects, wherein the controller module is further configured to selectively energize a magnetic field to attract the magnet, operably rotating the first conductor about the longitudinal axis toward one of the first rotational position or the second rotational position.

15. The contactor assembly of any of the disclosed aspects, wherein the controller module is further configured to selectively energize a magnetic field to repel the magnet, operably rotating the first conductor about the longitudinal axis toward one of the first rotational position or the second rotational position.

16. The contactor assembly of any of the disclosed aspects, further comprising a housing having a coil axially aligned with the magnet, wherein the coil is configured to generate the magnetic field when selectively energized by the controller module.

17. A method of operating a contactor assembly, the method comprising:

selectively applying a rotational force, by a controller module, relative to a first conductor rotatable about a longitudinal axis and having a first set of axially extending protrusions, such that the rotational force rotates the first conductor to conductively intermesh a conductive face of the first set of extending protrusions with a conductive face of a second set of extending protrusions of a second conductor axially aligned with the first conductor.

18. The method of any of the disclosed aspects, wherein selectively applying a rotational force includes energizing a first magnetic field, by the controller module, relative to a magnet fixed along an outer surface of the first conductor, such that the attraction of the first magnetic field and the magnet rotates the first conductor to conductively intermesh the conductive face of the first set of extending protrusions with the conductive face of a second set of extending protrusions of a second conductor.

19. The method of any of the disclosed aspects, further comprising selectively de-energizing the first magnetic field, by the controller module, such that the first conductor rotates to separate the conductive face of the first set of extending protrusions from the conductive face of the second set of extending protrusions.

20. The method of any of the disclosed aspects, further comprising selectively energizing a second magnetic field, by the controller module, the second magnetic field opposite of the first magnetic field, such that the repulsion of the second magnetic field and the magnet rotates the first conductor to separate the conductive face of the first set of extending protrusions from the conductive face of the second set of extending protrusions.

21. The method of any of the disclosed aspects, further comprising simultaneously de-energizing the first magnetic field and energizing a second magnetic field, by the controller module, the second magnetic field angularly spaced from the first magnetic field, such that the attraction of the second magnetic field and the magnet rotates the first conductor to separate the conductive face of the first set of extending protrusions To the extent not already described, the different features and structures of the various features can be used in combination as desired. That one feature is not illustrated in all of the aspects of the disclosure is not meant to be construed that it cannot be, but is done for brevity of description. Thus, the various features of the different aspects described herein can be mixed and matched as desired to form new features or aspects thereof, whether or not the new aspects or features are expressly described. All combinations or permutations of features described herein are covered by this disclosure.

This written description uses examples to detail the aspects described herein, including the best mode, and to enable any person skilled in the art to practice the aspects described herein, including making and using any devices or systems and performing any incorporated methods. The patentable scope of the aspects described herein are defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A contactor assembly, comprising:

a first conductor rotatable about a longitudinal axis and having a first set of axially extending protrusions, each of the first set of extending protrusions including a first radially extending angular face and a second radially extending angular face, and wherein the first angular face of one of the first set of extending protrusions is adjacent to the second angular face of another of the first set of extending protrusions; and a second conductor aligned with the longitudinal axis and rotationally fixed and having a second set of axially extending protrusions interdigitally arranged with the first set of protrusions, each of the second set of extending protrusions including a third radially extending angular face and a fourth radially extending angular face, and wherein the third angular face of one of the second set of extending protrusions is adjacent to the fourth angular face of another of the second set of extending protrusions;

wherein at least a subset of the first set of extending protrusions and at least a subset of the second set of protrusions are conductively connected when the first conductor is rotated about the longitudinal axis to a first rotational position, and wherein the first set of extending protrusions and the second set of protrusions are not conductively connected when the first conductor is rotated about the longitudinal axis to a second rotational position; and wherein, when interdigitally arranged, the first face of the first set of extending protrusions is facing the third face of the second set of extending protrusions, and the second face of the first set of extending protrusions is facing the fourth face of the second set of extending protrusions.

2. The contactor assembly of claim 1 further comprising a third conductor aligned with the longitudinal axis, spaced from the second conductor by the first conductor, and rotationally fixed.

3. The contactor assembly of claim 2 wherein the third conductor includes a third set of axially extending protrusions, wherein the first conductor includes a fourth set of axially extending protrusions, and wherein the third set and the fourth set of extending protrusions are interdigitally arranged.

4. The contactor assembly of claim 3 wherein the first set of extending protrusions are angularly aligned about the longitudinal axis with the fourth set of extending protrusions.

5. The contactor assembly of claim 3 wherein the second set of extending protrusions are angularly aligned about the longitudinal axis with the third set of extending protrusions.

6. The contactor assembly of claim 1 wherein second face of the first set of extending protrusions is in conductive contact with the fourth face of the second set of extending protrusions when the first conductor is rotated about the longitudinal axis to the first rotational position.

7. The contactor assembly of claim 1 wherein at least one of the third face and the first face includes a non-conductive layer.

8. The contactor assembly of claim 7 wherein the first face of the first set of extending protrusions is in non-conductive contact with the third face of the second set of extending protrusions when the first conductor is rotated about the longitudinal axis to the second rotational position.

9. The contactor assembly of claim 1 wherein the first conductor includes a magnet fixed along a first conductor outer surface.

10. The contactor assembly of claim 9, further comprising a controller module configured to selectively energize at least one coil configured to generate a magnetic field relative to the magnet.

11. The contactor assembly of claim 10 wherein the controller module is further configured to selectively energize the at least one coil to attract the magnet, operably rotating the first conductor about the longitudinal axis toward one of the first rotational position or the second rotational position.

12. The contactor assembly of claim 10 wherein the controller module is further configured to selectively energize the at least one coil a magnetic field to repel the magnet, operably rotating the first conductor about the longitudinal axis toward one of the first rotational position or the second rotational position.

13. The contactor assembly of claim 10, further comprising a housing having the at least one coil axially aligned with the magnet, wherein the coil is configured to generate the magnetic field when selectively energized by the controller module.

14. A method of operating a contactor assembly, the method comprising:

selectively applying a rotational force, by a controller module, relative to a first conductor rotatable about a longitudinal axis and having a first set of axially extending protrusions, each of the first set of extending protrusions including a first radially extending angular face and a second radially extending angular face, and wherein the first angular face of one of the first set of extending protrusions is adjacent to the second angular face of another of the first set of extending protrusions, such that the rotational force rotates the first conductor to conductively intermesh a conductive face of the first set of extending protrusions with a conductive face of a second set of extending protrusions of a second conductor axially aligned with the first conductor, each of the second set of extending protrusions including a third radially extending angular face and a fourth radially extending angular face, and wherein the third angular face of one of the second set of extending protrusions is adjacent to the fourth angular face of another of the second set of extending protrusions, and wherein, the first set of extending protrusions are interdigitally and axially arranged with the second set of extending protrusions, such that the first face of the first set of extending protrusions is facing the third face of the second set of extending protrusions, and the second face of the first set of extending protrusions is facing the fourth face of the second set of extending protrusions.

15. The method of claim 14, wherein selectively applying a rotational force includes energizing at least one coil configured to generate a first magnetic field, by the controller module, relative to a magnet fixed along an outer surface of the first conductor, such that the attraction of the first magnetic field and the magnet rotates the first conductor to conductively intermesh the conductive face of the first set of extending protrusions with the conductive face of a second set of extending protrusions of a second conductor.

16. The method of claim 15, further comprising selectively de-energizing the at least one coil, by the controller module, such that the first conductor rotates to separate the conductive face of the first set of extending protrusions from the conductive face of the second set of extending protrusions.

17. The method of claim 15, further comprising selectively energizing at least a second coil configured to generate a second magnetic field, by the controller module, the second magnetic field opposite of the first magnetic field, such that the repulsion of the second magnetic field and the magnet rotates the first conductor to separate the conductive face of the first set of extending protrusions from the conductive face of the second set of extending protrusions.

* * * * *